US009458757B2

(12) United States Patent
Schreckenberg et al.

(10) Patent No.: US 9,458,757 B2
(45) Date of Patent: Oct. 4, 2016

(54) MOTOR VEHICLE COOLANT PUMP

(75) Inventors: Stephan Schreckenberg, Pulheim (DE); Thomas Wienecke, Willich (DE); Bjoern Isenberg, Bochum (DE)

(73) Assignee: PIERBURG PUMP TECHNOLOGY GMBH, Neuss (DE)

( * ) Notice: Subject to any disclaimer, the term of this patent is extended or adjusted under 35 U.S.C. 154(b) by 583 days.

(21) Appl. No.: 13/996,548

(22) PCT Filed: Aug. 1, 2011

(86) PCT No.: PCT/EP2011/063210
§ 371 (c)(1),
(2), (4) Date: Aug. 8, 2013

(87) PCT Pub. No.: WO2012/084278
PCT Pub. Date: Jun. 28, 2012

(65) Prior Publication Data

US 2013/0309084 A1 Nov. 21, 2013

(30) Foreign Application Priority Data

Dec. 22, 2010 (EP) ..... 10196523

(51) Int. Cl.
*F01P 5/10* (2006.01)
*F04D 29/42* (2006.01)
*F04D 29/62* (2006.01)

(52) U.S. Cl.
CPC ..... *F01P 5/10* (2013.01); *F04D 29/426* (2013.01); *F04D 29/628* (2013.01)

(58) Field of Classification Search
USPC ..... 415/214.1; 417/321
See application file for complete search history.

(56) References Cited

U.S. PATENT DOCUMENTS

| | | | | |
|---|---|---|---|---|
| 2,757,945 | A * | 8/1956 | Bingham | F16L 19/0218 220/304 |
| 6,045,340 | A | 4/2000 | Batchelder et al. | |
| 2006/0057006 | A1 | 3/2006 | Williams et al. | |
| 2009/0056123 | A1 | 3/2009 | Phillips et al. | |
| 2010/0158723 | A1 | 6/2010 | Ihle et al. | |

FOREIGN PATENT DOCUMENTS

| | | |
|---|---|---|
| EP | 1 635 065 A1 | 3/2006 |
| EP | 2 200 155 A2 | 6/2010 |
| JP | 2010-24939 A | 2/2010 |

OTHER PUBLICATIONS

Email document Confirming English Translation of "Sprengring". Translated by John Koytcheff, German Translator, USPTO. Jul. 11, 2016.*

* cited by examiner

*Primary Examiner* — Nicholas J Weiss
*Assistant Examiner* — Paul Thiede
(74) *Attorney, Agent, or Firm* — Norman B. Thot

(57) ABSTRACT

A motor vehicle coolant pump for supplying coolant to an engine includes a two-part pump housing comprising a pump rotor housing part and a body housing part. The pump rotor housing part comprises a first mounting flange, and the body housing part comprises a second mounting flange which together fix the housing parts with respect to each other and allow a mounting of the housing parts on each other in every rotary position. A pump rotor is arranged in the pump rotor housing part. An axial coolant inlet and a tangential coolant outlet are provided on the pump rotor housing part. A rotary fixation comprises a recess at the pump rotor housing part and a nose which engages in the recess. The rotary fixation allows the pump rotor housing part and the body housing part to be mounted with respect to each other in only one single rotational angle.

7 Claims, 2 Drawing Sheets

MOTOR VEHICLE COOLANT PUMP

CROSS REFERENCE TO PRIOR APPLICATIONS

This application is a U.S. National Phase application under 35 U.S.C. §371 of International Application No. PCT/EP2011/063210, filed on Aug. 1, 2011 and which claims benefit to European Patent Application No. 10196523.4, filed on Dec. 22, 2010. The International Application was published in German on Jun. 28, 2012 as WO 2012/084278 A1 under PCT Article 21(2).

FIELD

The present invention relates to a motor vehicle coolant pump for supplying a coolant to an internal combustion engine of a motor vehicle or to other heat sources of a motor vehicle, the coolant pump comprising a housing having a separate housing part for the pump rotor.

BACKGROUND

Manufacturers of motor vehicle coolant pumps generally supply coolant pumps to a great number of different manufacturers of internal combustion engines or motor vehicles. The centrifugal pump comprising an axial coolant inlet and a tangential coolant outlet has become the standard pump design. Besides the type of drive of the coolant pump and the size of the coolant pump which, among other factors, is determined by the cooling capacity, the rotational angle of the tangential coolant outlet also varies relative to the body housing of the coolant pump. A coolant pump manufacturer therefore must even provide a plurality of different housing variants for a single type of coolant pumps having the same drive and the same capacity.

SUMMARY

An aspect of the present invention is to simplify the manufacture of coolant pumps having different housing variants.

In an embodiment, the present invention provides a motor vehicle coolant pump for supplying a coolant to a motor vehicle internal combustion engine which includes a two-part pump housing comprising a pump rotor housing part and a body housing part. Each of the pump rotor housing part and the body housing part are configured as one, separate, piece. The pump rotor housing part comprises a first mounting flange and the body housing part comprises a second mounting flange which are each configured to fix the pump rotor housing part and the body housing part with respect to each other and to allow a mounting of the pump rotor housing part and the body housing part on each other in every rotary position. A pump rotor is arranged in the pump rotor housing part. The pump rotor is configured to be rotated about an axis. An axial coolant inlet is provided on the pump rotor housing part. A tangential coolant outlet is provided on the pump rotor housing part. A rotary fixation comprises a recess at the pump rotor housing part and a nose configured to engage in the recess at the body housing part. The rotary fixation is configured to allow the pump rotor housing part and the body housing part to be mounted with respect to each other in only one single rotational angle.

BRIEF DESCRIPTION OF THE DRAWINGS

The present invention is described in greater detail below on the basis of embodiments and of the drawings in which.

DETAILED DESCRIPTION

Figure 1:
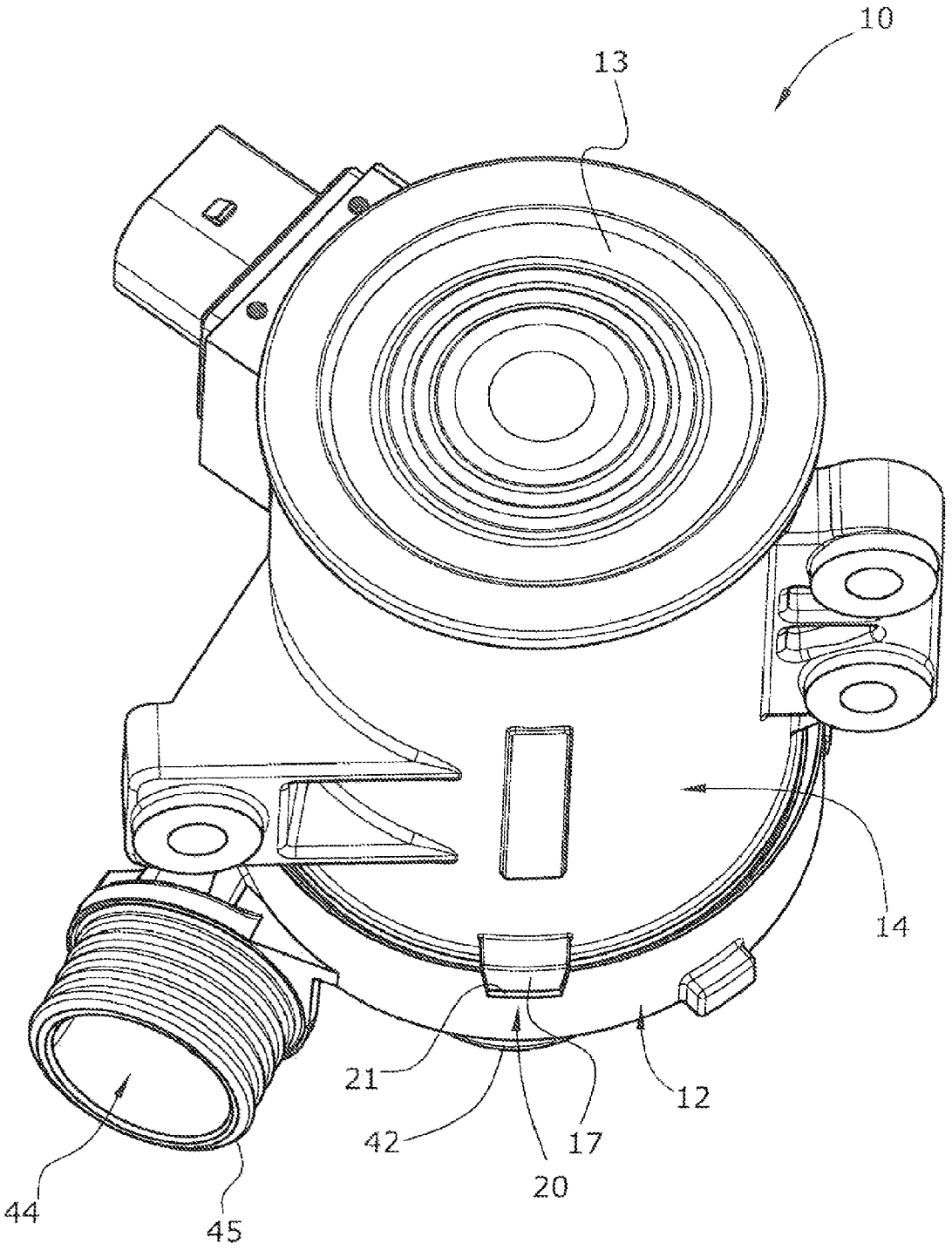
FIG. 1 shows a perspective view of the outer side of an electric coolant pump for a motor vehicle with a body housing part and a pump rotor housing part which has an axial coolant inlet and a tangential coolant outlet.
Figure 2:
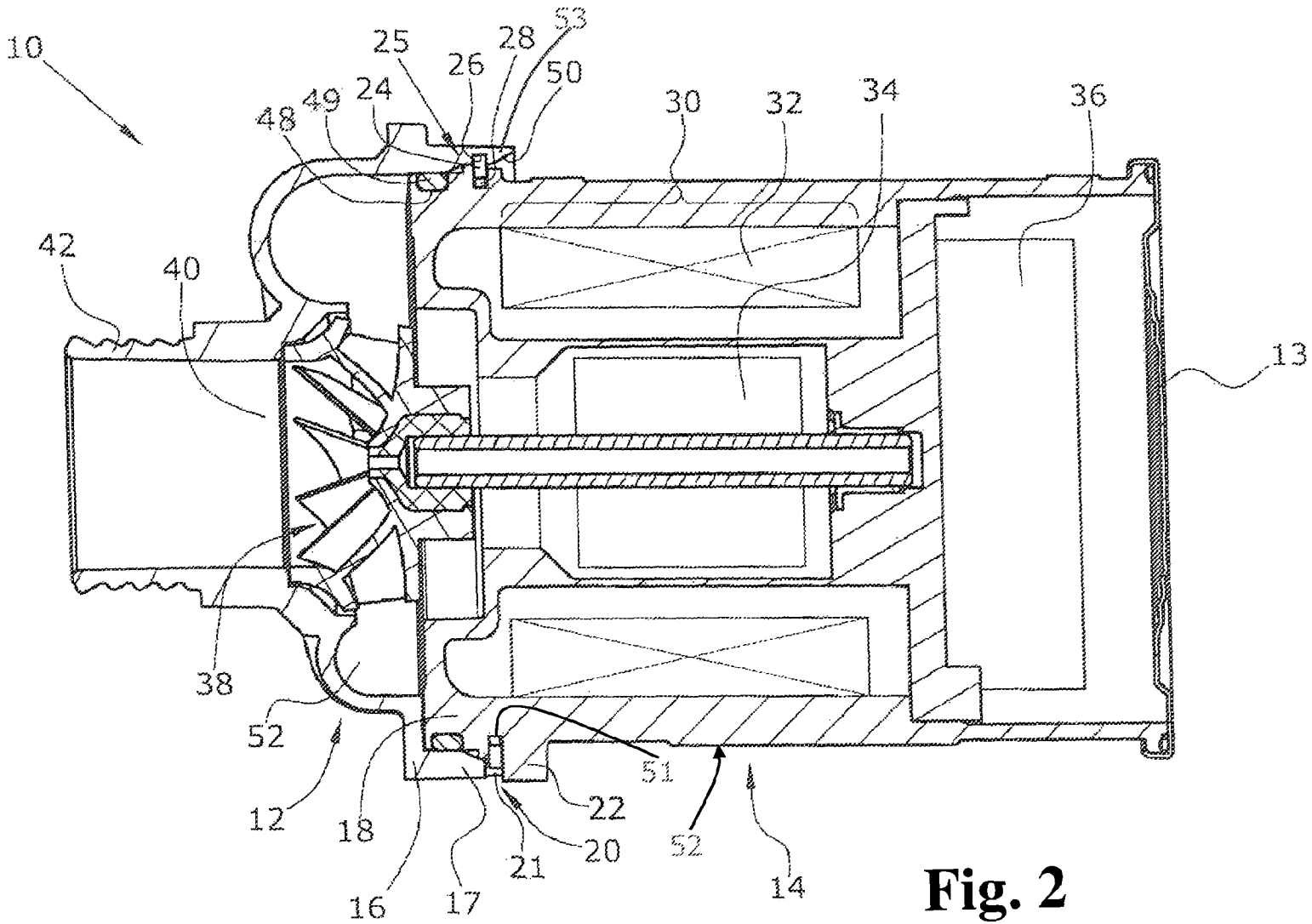
FIG. 2 shows a longitudinal section through the coolant pump for a motor vehicle of FIG. 1.

In an embodiment of the present invention, the motor vehicle coolant pump comprises a two-part pump housing with a one-piece pump rotor housing part and a separate one-piece base housing part. A pump rotor rotatable about an axis is arranged in the pump rotor housing part. The pump rotor housing is thus not formed by the engine block. The pump rotor housing part is provided with an axial coolant inlet and a tangential coolant outlet that may also have a radial component. Each of the two housing parts has an annular mounting flange that fixes the housing parts radially with respect to each other and basically enables the assembly of the housing parts in any rotational position relative to each other. A separate rotary fixation is moreover provided which is defined by a recess at one housing part and a nose at the other housing part, the nose engaging into the recess. It is only through the rotary fixation that an assembly of the two housing parts is possible at only one single angle of rotation. Other rotational angles of assembly are blocked. The recess and the nose can, for example, be respectively provided directly on the mounting flange.

The rotary fixation is thus realized but in a very minimalistic form. The recess in the one housing part can, for example, be made with low effort by implementing a machining process. The mold for this housing part therefore does not have to be modified at all in order to provide a rotation-proof fixation of the pump rotor housing part to the base housing part under different angles of rotation. At the same time, a single rotational angle of assembly is respectively defined using simple means, the angle excluding an incorrect assembly.

In an embodiment of the present invention, the two mounting flanges can, for example, form a plug-in flange connection with a cylindrical flange collar of the mounting flange of the pump rotor housing part being set over the radial outer side of the mounting flange of the base housing part. The two mounting flanges are thereby radially fixed with respect to each other while basically still being adapted to be rotated relative to each other. The two mounting flanges thus respectively have horizontal ring surfaces lying in a horizontal plane and facing each other, as well as cylinder ring surfaces facing each other.

In an embodiment of the present invention, a sealing ring can, for example, be arranged between the flange collar and the opposite mounting flange, the sealing ring mounted in a radial sealing ring annular groove in one of the two mounting flanges. The sealing ring is thus compressed radially and does not have to be compressed by axial forces.

In an embodiment of the present invention, the rotary fixation recess can, for example, be provided axially at the flange collar. The rotary fixation nose can moreover, for example, be formed integrally with the cylindrical body housing part, and the nose can, for example, extend radially from the cylindrical outer side of the body housing part. As already described above, it is thus possible to define basically any rotational angle for the tangential coolant outlet with respect to the body housing part without any modification of the molds for the two housing parts and by simple milling of the rotary fixation recess at the corresponding rotational position.

In an embodiment of the present invention, a self-locking axial fixation arrangement can, for example, be provided for the axial fixation of the two housing parts to each other. When the two mounting flanges are pushed axially one upon the other, the axial fixation arrangement locks in the end position. The two housing parts or the two mounting flanges need not be fastened to each other by screws. Manufacture is very simple and economic to realize for this reason.

In an embodiment of the present invention, the axial fixation arrangement can, for example, be formed by an annular groove in the pump rotor housing part, opening radially inwards, a corresponding annular groove at the body housing part, opening radially outwards, and a radially pre-stressed snap ring extending radially into both annular grooves. The snap ring can, for example, be biased radially outwards and be pre-mounted in the annular groove of the body housing part prior to the assembly of the two flanges. Designing the fixation arrangement with a snap ring offers a high reliability of assembly and provides sufficiently large axial retaining forces that exceed the axial forces caused by the coolant pressure in the pump rotor housing part.

In an embodiment of the present invention, one of the two mounting flanges can, for example, have a wedge ring surface of wedge-shaped cross-section which pushes back the snap ring and possibly the sealing ring in the axial direction when the two mounting flanges are pushed together in the axial direction. The snap ring and, if applicable, the sealing ring are here pre-mounted on the mounting flange that does not have the wedge ring surface. In the course of the axial mounting movement, the wedge ring surface thus pushes both the snap ring and the sealing ring radially into the respective annular groove and thus serves as a so-called joining chamfer. An electric drive motor can, for example, be arranged in the body housing part that drives the pump rotor. This would be an electric coolant pump.

The following is a detailed description of an embodiment of the present invention with reference to the drawings.

FIG. 1 illustrates a motor vehicle coolant pump 10 in perspective view. The coolant pump 10 serves to supply a coolant, for example, water, to an internal combustion engine of a motor vehicle. The coolant pump 10 has an essentially two-part pump housing composed basically of a metallic and cylindrical body housing part 14 and a pump rotor housing part 12 of metal or plastic material mounted thereon at a longitudinal end thereof. At its other, distal end, the body housing part 14 is closed with a lid 13 beneath which the microelectronics 36 is arranged.

An electric drive motor 30 is arranged in the cylindrical body housing part 14, which electric drive motor 30 comprises, among other parts, stator coils 32 on the stator side and permanent-magnetic rotor poles 34 on the rotor side. The drive motor 30 is designed as a separating can motor, i.e., the entire motor rotor, including the rotor poles 34, is arranged in the wet portion and is shielded in a liquid-tight manner from the stator coils 32.

The rotor poles 34 further comprises a pump rotor 38 that is co-rotatably connected with the drive motor 30 and which is surrounded by the pump rotor housing part 12. The pump rotor housing part 12 comprises an axial coolant inlet 40 with an inlet port 42 and a tangential coolant outlet 44 with a tangential outlet port 45. The coolant flows through the pump inlet 40 into the pump rotor housing part 12, is caused to rotate by the pump rotor 38, and is moved outward into the outlet volute 52, from where the coolant flows out tangentially through the coolant outlet 44.

The two housing parts 12, 14 each have a ring-like mounting flange 16, 18 fixing the two housing parts 12, 14 radially and axially with respect to each other. Without the rotary fixation 20 to be described hereinafter, the two housing parts 12, 14 are fixed by the mounting flange radially and, in one direction, also axially with respect to each other, but also in a manner to be rotatable relative to each other. Fixation against rotation is provided by a rotary fixation 20 essentially formed by a recess 21 in a cylindrical flange collar 17 of the mounting flange 16 of the pump rotor housing part 12 and a nose 22 of the body housing part 14 engaging into the recess 21.

The nose 22 projects radially outward from the cylindrical outer side 52 of the body housing part 14. Both the pump rotor housing part 12 and the body housing part 14 can be cast or injection molded with the same mold, regardless of the rotational angle of the coolant outlet 44 relative to the body housing part 14. For the individualization and definition of the rotational angle of the coolant outlet, it is only necessary to machine the recess 21 at the appropriate position of the pump rotor housing part. As an alternative, the recess 21 can be provided using a simple insert in the respective mold for the pump rotor housing part 12. The rotational angle of the coolant outlet 44 can thus be defined with respect to the base housing part 14 with very little effort.

The two mounting flanges 16, 18 form a plug-in flange connection as it is known, for example, from pipe joints. The assembly of the pump rotor housing part 12 to the body housing part 14 is effected without screws or similar means. A self-locking axial fixation arrangement 25 is provided for axial fixation. The axial fixation arrangement 25 is defined by an annular groove 26 in the flange collar 17 of the pump rotor housing part 12, which annular groove 26 is open to the radial inner side, a corresponding annular groove 28 in the cylindrical outer side 52 of the body housing part 14 (i.e., the radial outer side 51 of mounting flange 18), which annular groove 28 is open to the radial outer side and lies in the same transversal plane, and a snap ring 24 prestressed radially outward and extending into both annular grooves 26, 28 when in the mounted position.

Distally of the annular groove 28 for the snap ring washer, seen in the axial direction, the body housing part 14 has an annular sealing ring groove 48 for a sealing ring 49. The radial inner side of the flange collar 17 of mounting flange 16 has a proximally widening wedge ring surface 50 having a wedge-shaped cross section 53 which, when the two mounting flanges 16, 18 are pushed together axially as required for assembly, first pushes the sealing ring 49 and then pushes the snap ring 24 radially into their respective annular groove 48, 28. The wedge angle is between 5° and 30°. In the mounted position or the final position, the snap ring 24 springs outward into the annular groove 26 of the flange collar 17, whereby the two mounting flanges 16, 18 are finally interlocked axially in a non-detachable manner.

The present invention is not limited to embodiments described herein; reference should be had to the appended claims.

What is claimed is:

1. A motor vehicle coolant pump for supplying a coolant to a motor vehicle internal combustion engine, the motor vehicle coolant pump comprising:

a two-part pump housing comprising a pump rotor housing part and a body housing part, each of the pump rotor housing part and the body housing part being configured as a separate part, the pump rotor housing part comprising a first mounting flange and the body housing part comprising a second mounting flange which are each configured to fix the pump rotor housing part and the body housing part with respect to each other and to allow a mounting of the pump rotor housing part and the body housing part on each other;

a pump rotor arranged in the pump rotor housing part, the pump rotor being configured to be rotated about an axis;

an axial coolant inlet provided on the pump rotor housing part;

a tangential coolant outlet provided on the pump rotor housing part;

a rotary fixation comprising a recess at the pump rotor housing part and a nose configured to engage in the recess at the body housing part, the rotary fixation being configured to allow the pump rotor housing part and the body housing part to be mounted with respect to each other in only one single rotational position;

a self-locking axial fixation arrangement configured to axially fix the pump rotor housing part and the body housing part to each other, wherein, the pump rotor housing part further comprises an inwardly open annular groove, the body housing part further comprises an outwardly open annular groove which is configured to correspond to the inwardly open annular groove, the self-locking axial fixation arrangement is formed by the inwardly open annular groove in the pump rotor housing part, the outwardly open annular groove in the body housing part, and by a radially pre-stressed snap ring configured to extend radially into each of the inwardly open annular groove and the outwardly open annular groove, and the first mounting flange comprises a wedge ring surface comprising a wedge-shaped cross-section, the wedge ring surface being configured to push on the radially pre-stressed snap ring in a radial direction when the first mounting flange and the second mounting flange are pushed together in an axial direction, wherein, the inwardly open annular groove in the pump rotor housing part is interrupted in an area of the recess.

2. The motor vehicle coolant pump as recited in claim 1, wherein the first mounting flange further comprises a flange collar and the second mounting flange comprises a second mounting flange radial outer side, the first mounting flange and the second mounting flange being configured to form a plug-in flange connection, and the flange collar of the first mounting flange being configured to be set over the second mounting flange radial outer side.

3. The motor vehicle coolant pump as recited in claim 2, wherein the recess is arranged axially in the flange collar.

4. The motor vehicle coolant pump as recited in claim 3, wherein the body housing part further comprises a body housing part outer side, and the nose is arranged to protrude radially from the body housing part outer side.

5. The motor vehicle coolant pump as recited in claim 2, further comprising a radial annular sealing ring groove for a sealing ring, the radial annular sealing ring groove for the sealing ring being arranged in the second mounting flange.

6. The motor vehicle coolant pump as recited in claim 5, wherein the wedge ring surface is further configured to push on the sealing ring in the radial direction when the first mounting flange and the second mounting flange are pushed together in the axial direction.

7. The motor vehicle coolant pump as recited in claim 1, further comprising an electric drive motor arranged in the body housing part, the electric drive motor being configured to drives the pump rotor.

* * * * *